United States Patent [19]

Fixsen et al.

[11] Patent Number: 4,796,432

[45] Date of Patent: Jan. 10, 1989

[54] LONG HOLD TIME CRYOGENS DEWAR

[75] Inventors: Dale J. Fixsen, St. Louis Park; Roger N. Hastings, Burnsville; John A. Imsdahl, Richfield, all of Minn.

[73] Assignee: Unisys Corporation, Blue Bell, Pa.

[21] Appl. No.: 79,200

[22] Filed: Oct. 9, 1987

[51] Int. Cl.[4] ..... F17C 1/00

[52] U.S. Cl. ..... 62/45; 62/514 R

[58] Field of Search ..... 62/45, 514 R

[56] References Cited

U.S. PATENT DOCUMENTS

| | | | |
|---|---|---|---|
| 2,532,708 | 12/1950 | Goddard | 62/45 |
| 2,643,022 | 6/1953 | Cornell | 220/15 |
| 2,863,297 | 12/1958 | Johnston | 62/45 |
| 3,119,238 | 1/1964 | Chamberlain et al. | 62/45 |
| 3,314,773 | 4/1967 | Deiness | 62/45 |
| 3,325,999 | 6/1967 | Schroeder, Jr. | 62/45 |
| 3,358,472 | 12/1967 | Klipping | 62/45 |
| 3,364,687 | 1/1968 | Kolm | 62/45 |
| 3,374,638 | 3/1968 | Basile et al. | 62/45 |
| 4,212,169 | 7/1980 | Kneip, Jr. | 62/45 |
| 4,481,778 | 11/1984 | Reinker et al. | 62/45 |
| 4,606,194 | 8/1986 | Pirtle et al. | 62/6 |
| 4,613,816 | 9/1986 | Zeamer | 324/248 |
| 4,625,229 | 11/1986 | Maier | 357/81 |
| 4,674,289 | 6/1987 | Andonian | 62/45 |

OTHER PUBLICATIONS

Sisler, Harry H. and Davidson, Arthur W., General Chemistry A Systematic Approach, The Macmillan Company, 1949, p. 391.

*Primary Examiner*—Ronald C. Capossela
*Attorney, Agent, or Firm*—Glenn W. Bowen

[57] ABSTRACT

A liquid cryogen dewar is constructed in which two or more liquid cryogen chambers are suspended within a case wherein the innermost cryogens have a higher boiling, or sublimation, temperature than the cryogen in the next outermost chamber. The chambers may contain liquid helium, liquid nitrogen and solid $CO_2$ proceeding from the innermost to the outermost chamber. Superconducting electronic circuitry such as SQUID devices may be connected to the outer case of the liquid helium cryogen chamber. An isothermal shield is also suspended outside the helium chamber. The elements of the dewar are supported by glass epoxy rods and polyester cords of low thermal conductivity. A fill and exhaust port is provided which communicates with fill and exhaust tubes that are heat sunk to various locations of the rods and the Dacron cords.

20 Claims, 2 Drawing Sheets

LONG HOLD TIME CRYOGENS DEWAR

BACKGROUND OF THE INVENTION

The usefulness of superconducting electronic devices, particularly in field applications where cryogens may not be easily accessible is currently limited by the ability of dewars which hold the liquid cryogens to maintain a superconducting temperature for much more than one week. The existence of long hold time dewars, which can hold superconducting temperatures for 6 months or more, is expected to accelerate the development of devices for laboratory use, for magnetic field measurements, for digital processing using superconducting sensing devices and for other applications.

Superconducting electronic devices, such as superconducting quantum interference devices (SQUID), may be mounted on the outer surface of a chamber, which contains a suitable liquid cryogen, such as helium or nitrogen. Use of SQUID devices in this manner for superconducting magnetic sensors is severely limited by the normal one week dewar hold time. The present invention provides a liquid dewar which may hold liquid cryogens at superconducting temperatures for up to six months or more.

SUMMARY OF THE INVENTION

The present invention provides a dewar construction which has substantially no neck portion, but which has a fill and exhaust port, suspension rods and cords to suspend a series of liquid cryogen chambers within the dewar. The rods, cords and tubes are heat sunk and are connected to each other. Each of the cryogenic liquids has a higher boiling, or sublimation temperature, than its neighbor as the dewar is traversed from its interior to its exterior. In other words, the cryogen in each suspended chamber is maintained in a state such that each cryogen has a progressively higher phase change temperature proceeding from the innermost one of said cryogen chambers to the outermost one of the chambers.

BRIEF DESCRIPTION OF THE DRAWINGS

The present invention is illustrated by reference to the drawings in which.

TECHNICAL DESCRIPTION OF THE INVENTION

Figure 1:
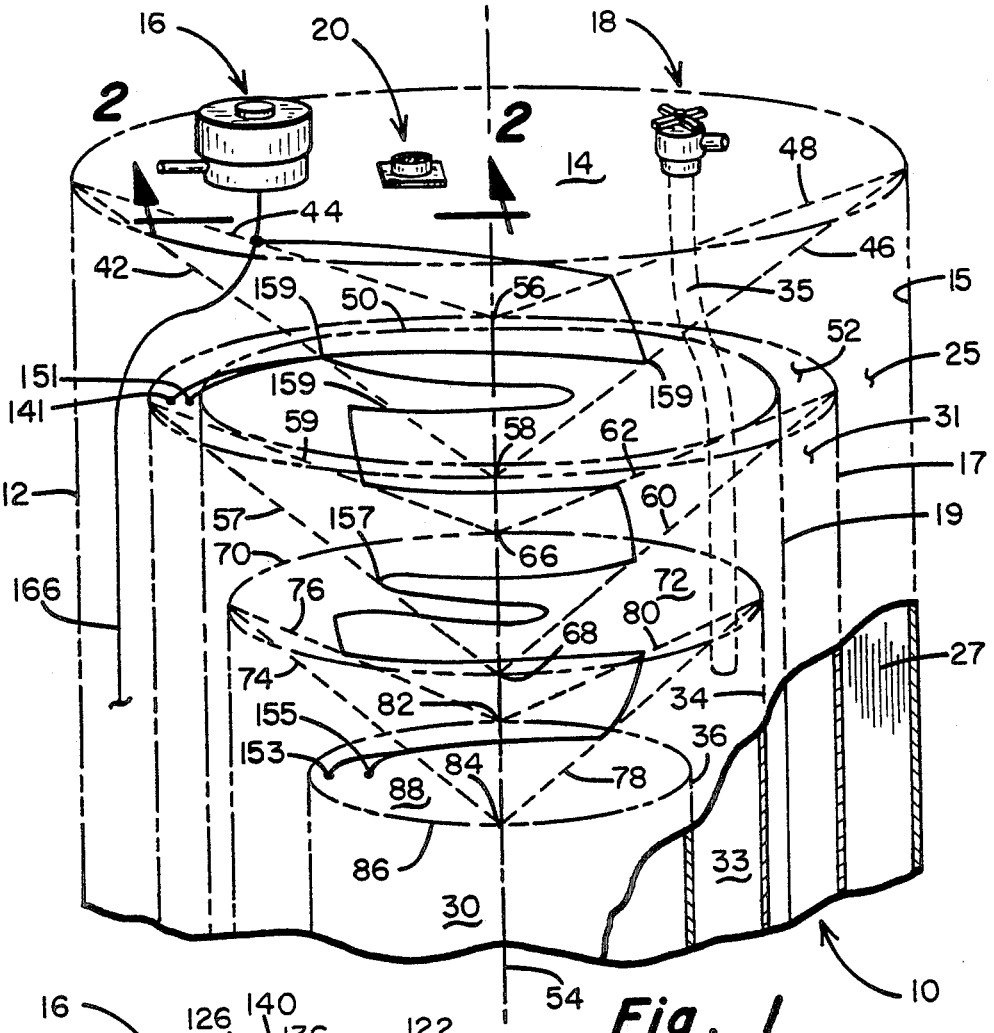
FIG. 1 is a partial perspective and cross-sectional view of the top portion of a two component liquid cryogen dewar constructed in accordance with the present invention.

The present invention as shown by reference to the figures in which FIG. 1 shows a long hold time dewar 10 which is constructed in accordance with the present invention. The outer case 12 of the dewar 10 is preferably formed of fiber glass or polyvinyl chloride. The top surface 14 of the case receives a fill and exhaust port 16 which passes through the top surface into the interior of the dewar. The fill and exhaust port 16 is preferably designed to double as a relief valve in case of pressure buildup in one or more of the chambers of the dewar. A vacuum pump out port 18 also passes through the surface 14 into communication with the interior of the dewar. A female electrical connector 20, which is secured in the top surface 14, may be used to provide electrical connections to superconducting electronic circuitry (not shown) within the dewar.

Figure 2:
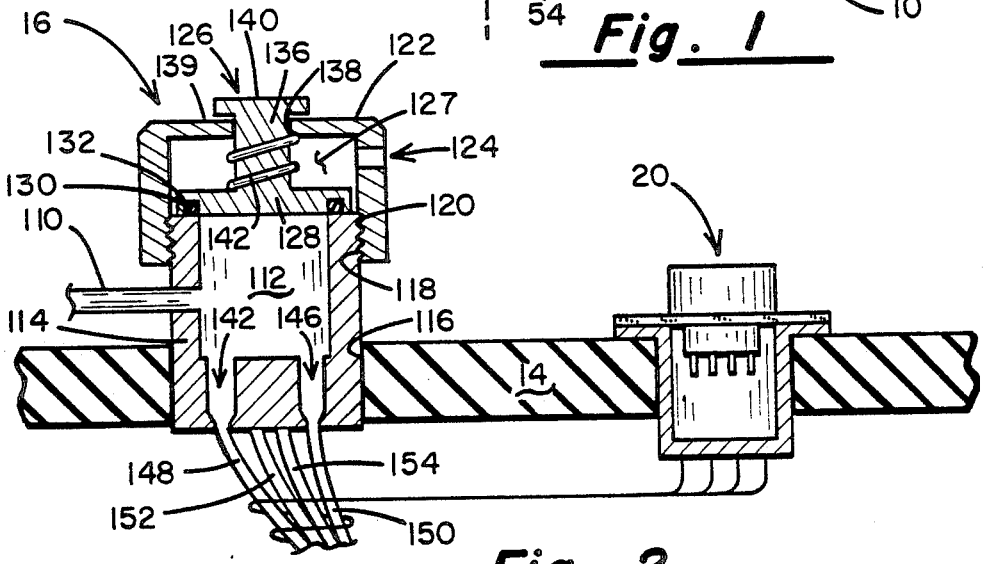
FIG. 2 the partial cross-sectional view taken along the lines 2—2 of FIG. 1, which shows the fill and exhaust port and an electrical connector for connecting to superconducting electrical circuitry in the dewar.

One of the liquid cryogens employed in the embodiment of FIGS. and 1 and 3 may be liquid nitrogen and the other may be liquid helium, although other cryogens may be utilized in accordance with the teachings of the present invention. These same two liquid cryogens, liquid nitrogen and liquid helium, may be employed in the embodiment of FIG. 4, along with solid carbon dioxide ($CO_2$) The liquid nitrogen in the embodiment of FIG. 1 is contained in the chamber 31, which is a cylindrical pipelike enclosed container having an outer wall 17 and an inner wall 19, and a hollow interior inwardly of the wall 19. The wall 17 is spaced from the wall 15 of the outer case 12 to form an insulating chamber 25. The insulating space 25 may be filled with a number of layers of superinsulation 27 of the types known to those skilled in the art (only a portion of these layers is shown in FIG. 2). For example, in the representative embodiment of the present invention 45 layers of superinsulation are utilized. Superinsulation may consist of a loosely wound multi-layered foil made of a metalized polymer film to provide low thermal conductivity and extremely low thermal capacity.

The chamber 31 for containing the nitrogen is preferably constructed of either glass-epoxy or quartz-epoxy or polyvinyl chloride. In the representative embodiment, the dewar may have a 30 centimeter outer diameter and a length of 40 centimeters. The cylindrically shaped nitrogen chamber 31 may hold approximately 2.3 liters of nitrogen.

The innermost cylindrical liquid helium containing chamber 30 is preferably formed of a metal, or a metal coated material, to prevent helium diffusion into the space 33 between the wall 36 of the helium chamber and a cylindrically shaped isothermal shield 34. The wall of the liquid helium chamber 30 is preferably constructed with a titanium-aluminum-tin alloy, which is approximately 30 mills thick, or quartz or quartz epoxy. The space 33 may be evacuated through the tube 35 that is coupled to the vacuum pump-out port 18. The isothermal shield 34 may be constructed of a foil form of litz wire, or other suitable conductive metal, or it may have a metalized, thermally conductive, inner and outer metallic surfaces. The isothermal heat shield 34 is formed as a cylindrical hollow container and, therefore, has closing upper and lower ends, such as the top surface 72 shown in FIG. 1. A corresponding bottom enclosing surface (not shown) closes off the bottom portion of the isothermal shield. In the representative embodiment, the helium chamber 30 may contain approximately 1.6 liters of liquid helium. This embodiment is expected to be capable of maintaining a superconducting temperature for about six months.

A superconducting magnetic sensor, such as a Superconducting Quantum Interference Device (SQUID) may be mounted on the wall 36 of the helium chamber 30 when a SQUID or other superconducting electronic circuitry is mounted on the wall 36. The wall 36 should be constructed of a material which has a low electrical conductivity at 4.2° K. (Kelvin) to limit Johnson noise. The helium chamber 30 may contain slosh baffles to inhibit motion of the liquid helium and to limit excess boil-off due to helium splashing onto relatively warm surfaces. A honeycomb baffle, (not shown), as described in co-pending application Ser. No. 887,667, entitled Anti-Slosh Apparatus for Liquid Containers, filed July 21, 1986, is suitable for this purpose. The disclosure of Ser. No. 887,667 is hereby incorporated by reference into this application. If such a honeycomb baffle is used, it will take up only about 3% of the helium chamber, and will confine the liquid helium in small diameter vertical columns of the honeycomb baffle.

Figure 3:
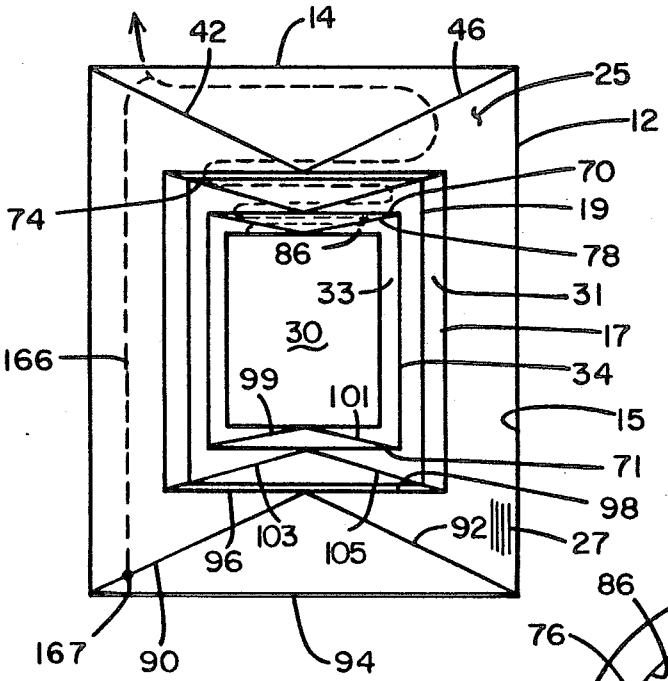
FIG. 3 is side cross-sectional view of a schematically illustrated two component liquid cryogen dewar like FIG. 1 with certain features of FIG. 1 not shown.

The various chambers of the dewar and the isothermal shield are suspended by cords from their next encircling neighbor to minimize vibrations, which could adversely affect the operation of SQUID sensors, or other electronic circuitry included in the dewar, and to minimize thermal conductivity. For example, glass epoxy rods 42, 44, on the order of 6.4 millimeters in diameter in the representative embodiment, are fastened to approximately the edge of where the outer sidewall 15 and the top surface 14 of the case 12 join. The rods 42, 44 diverge from this junction point to the points 56, 58 on the inner rim 50 of the top surface 52 of the nitrogen chamber 31, to support the nitrogen chamber 31 in the case 12 in a suspended manner as shown in FIG. 1 and 3. The rods 42, 44 join the rim 50 on opposite sides of the central axis 54 of the dewar 10. Another pair of glass epoxy rods 46, 48 extend from the right-hand junction of the outer side wall 15 and the top surface 14 to the same junction points 56, 58.

Proceeding towards the interior of the dewar, two pairs of polyester cords 57, 59 and 60, 62 are secured, respectively, to the left-hand and right-hand junctions of the top surface 52 and the outer wall 17 of the nitrogen chamber 31. These cords provide support for the isothermal shield 34 by connection to the junction areas 66, 68 which are also desirably located on the rim 70 of the top surface 72 of the isothermal shield 34, on along opposite sides of the axis 54. In a corresponding manner, the helium chamber 30 is suspended by two more pairs of polyester cords 74, 76 and 78, 80. These cords are respectively connected to the junction point of the side wall 36 and the top surface 72 of the isothermal shield 34, and at their lower ends to the junction points 82, 84 on the rim 86 of the top wall 88 of the helium chamber 30 on opposite sides of the central axis 54.

Corresponding sets of glass epoxy or fiberglass rods and cords are also employed at the bottom of the dewar to support the chambers and the heat shield, as shown in FIG. 3. The rods 90, 92 join to the bottom 94 and to the side wall 15 of the dewar case and extend to the rim 96 of the bottom surface 98 of the nitrogen chamber 31. FIG. 3 omits some of the elements shown in FIG. 1 since its purpose is to schematically illustrate that the suspension cords and rods on the bottom of the dewar are identical to those found on the top of the dewar. The cords 99, 101, 107, 109, which are used to suspend the isothermal shield and the helium chamber are arranged and connected in the manner previously described in connection with the suspension of the isothermal shield and the helium chamber at the top of the dewar.

Figure 5:
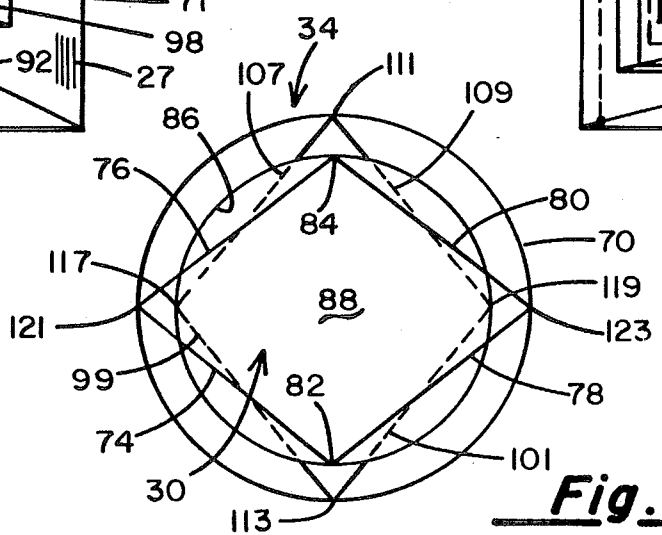
FIG. 5 is a schematic illustration of a dewar constructed in accordance with the present invention looking from the top down into the interior of the dewar, which shows the arrangement of one set of support rods and one set of support cords.

FIG. 5 illustrates the preferred arrangement of the polyester cords at the top and bottom of the dewar relative to one another. Looking down into the dewar, only the cords which support the helium chamber are illustrated for clarity of illustration, but the same pattern may be used to support the other elements, such as the isothermal shield and the other chambers of the dewar. As previously described, the polyester cords 74, 76 and 78, 80 extend from the rim 70 of the isothermal shield 34 to the to junction points 82, 84 on the rim 86 of the top surface 88 of the helium chamber 30. The rods 99, 101, 107, 109 connect to the junction points 117, 119 on the rim 71 at the bottom of the isothermal shield in a manner such that the origination points 121, 123 of the upper cords 74, 76, 78, 80 are located outwardly of the junction points 117, 119. In a corresponding manner, the origination points 111, 113 for the lower polyester cords 99, 101, 107, 109 on the rim 71 are connected outwardly of the junction points 82, 84 where the upper polyester cords are connected on the rim 70. The cords are thus interconnected in a generally diamond-shaped pattern, as seen from the top in FIG. 5.

Although, in the representative showing for the isothermal shield and the helium chamber are shown, the other polyester cord connections. For example, the cords between the nitrogen chamber and the isothermal shield, may be also arranged in a similar staggered fashion. The glass epoxy rods may also be connected to the nitrogen chamber in such a manner. While this connection scheme is preferred, it is not essential to broad teachings of the present invention, however.

The separate nitrogen and helium chambers are filled through the fill and exhaust port 16, which also may be used to exhaust gas from the cryogen chambers via the exhaust gas vent tube 110. The vent tube 110 extends from the chamber 112 through the body 114 of the fill-exhaust port 16. The fill-exhaust port is secured in a circular opening 116 in the top surface 14 of the dewar. The body 114 has threads 118 formed at its upper end which engage threads 120 on the removable cover 122. The cover 122 has an exhaust channel 124 in it for relieving over pressure gas. The exhaust channel 124 extends from the outside of the cover 120 into the interior space 127.

A poppet 126 overlies the chamber 112. The poppet 126 has a lower generally circular shaped closure ring 128, which in conjunction with the 0 ring 130, that is inserted into the recess 132 on the bottom of the closure ring 128, provides a seal between the closure ring 128 and the top surface 134 of the body 114, The closure ring 128 is joined by an integrally formed neck 136 which extends upwardly through the interior space 127 and through a circular hole 138 in the top 139 of the cover 122. The head 140 has a diameter larger than the hole 138 and extends upwardly past the top 139.

The closure ring 128 is normally forced downward by the spring 142 which encircles the neck 136 so the chamber 112 will normally be sealed off, as will the hole 138. With the poppet in this position, exhaust gas may be vented through the tube 110. During normal operation of the device the over-pressure exhaust channel 124 is also sealed off. If the pressure of the device should become too high, it will be vented through the exhaust-fill tubes 148–154, which are in fluid communication with the interior of the separate chambers of the dewar, in a manner which is subsequently described. Any excess pressure will force the poppet 126 upwardly due to pressure on the bottom surface of closure ring 128 until the poppet reaches the point where the chamber 122 is in communication with the exhaust channel 124, which allows excess pressure to escape.

Two of the exhaust-fill tubes 148–154 are associated with each of the chambers 30 and 31, and are coupled to four associated ports. For example, the port 142 may be used for both filling and exhausting the nitrogen chamber 31 while the port 146 may be used for exhausting the nitrogen chamber. A similar pair of ports (not shown) appear behind the ports 142 and 146 for filling and exhausting the helium chamber 30. Each of the ports for exhausting and filling the chambers 30 and 31 are connected to a separate exhaust/fill tube. For example, the tube 148 leads from the port 142 while the tube 150 leads from the port 146. The ports for filling and exhausting the helium inner chamber 30 receive the tubes 152, 154 respectively.

These tubes enter the space between the dewar case 12 and the outer wall 15 of the nitrogen chamber 31 and wind back and forth in a serpentine manner to the top surface 52 where they make fluid communication with the interior of the nitrogen chamber 31. The purpose of winding the tubes in this manner is to insure that they make intimate thermal contact with the glass epoxy rods and polyester cords at a number of the points. The tubes in the illustrative example are 0.125 inch diameter, have a 10 mill wall thickness and are preferably constructed of stainless steel tubes, or other suitable nonmagnetic metal, if the dewars are being used in conjunction with magnetic sensoring circuitry. By heat sinking the tubes to the rods and cords at various locations 159 an isothermal heat sink for the tubes, (at approximately 30° K. in the representative embodiment), may be obtained. A further improvement in heat sinking of the tubes may be achieved by stringing 3 mil manganin or phosphor bronze wires through the exhaust tubes (not shown). The tubes in the representative embodiment are approximately 50 cm long.

The 148, 150 tubes in the embodiment of FIG. 1 are in intimate contact throughout most of their length to the points 149, 151 where they communicate with the nitrogen chamber 31. The other pair of tubes 152, 154 proceed in a similar manner to points 153, 155 on the top surface 88 of the helium chamber 30 where they enter into this chamber. This pair of tubes must pass through the upper surface 72 of the isothermal shield 34 to reach the top surface 88 of the helium chamber 30. The tube 148 is used for both filling the chamber 26 with nitrogen and for exhausting into the air, while the tube 150 is utilized only for exhaust. In a similar manner the tube 152 is used for filling the helium chamber and for exhausting it, while the tube 154 is used only for exhaust in the described embodiment.

In order to increase the heat sinking effectiveness of heat at the bottom of the dewar, a litz wire bundle 166 (see FIG. 3) may pass down through the chamber 25 of the dewar to the glass epoxy rods 92 at the bottom of the dewar (see FIG. 3). A litz wire bundle consists of a number of fine strands of wire, on the order of 40 strands or more per bundle of high purity copper wire. The litz wire bundle may be attached to the polyester cords and/or epoxy rods at an arbitrary number of locations in order to provide a number of heat sink locations, or in other words, to drive the rods and cords to nearly the same temperature at either end of the litz wire. In FIG. 3 the connection of the Litz wire is showed only at the point 167 although it is understood that connection should be made at many points to the polyester cords or the glass epoxy rods. Safety features, such as conventional weakened portions in the helium and nitrogen chambers (not shown) may also be included to pop open at predetermined pressures for safety reasons.

Figure 4:
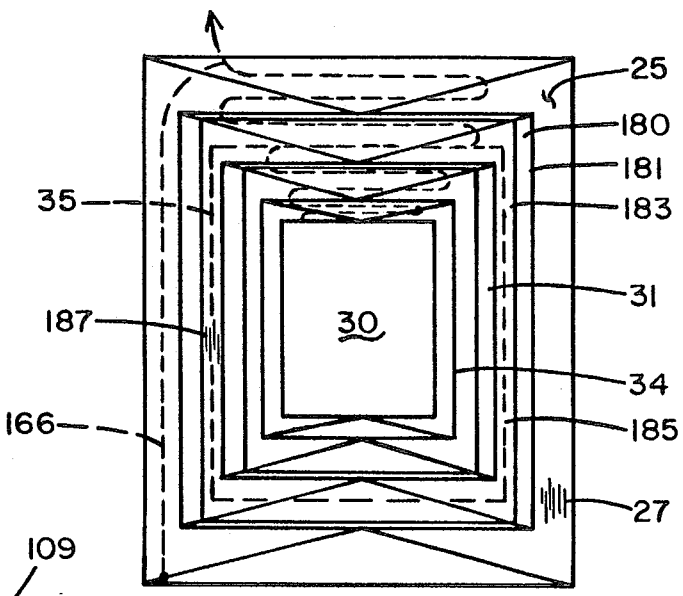
FIG. 4 is a side cross-sectional view of a schematically illustrated three component cryogen dewar with certain features not shown.

FIG. 4 shows and alternate embodiment of the present invention in which an additional pipe-like chamber 180 that is enclosed at its top and its bottom is constructed with an outer wall 181 and an inner wall 183 to hold solid carbon dioxide ($CO0_2$). The heat shield 34 is again suspended in the evacuated chamber 33, and the helium chamber 30 is suspended in the center of the dewar. The additional chamber 180 provides an additional insulating space 185 on the outside of the nitrogen chamber 31. The space 185, like the space 25, may be filled with layers of superinsulation. For example, in a representative embodiment, this may again include 45 layers of superinsulation 187 (only a portion which is shown in FIG. 4). The solid $CO_2$ chamber will then be suspended by the polyester rods in the same manner that the nitrogen chamber is supported in the dewar of FIG. 3. The nitrogen chamber is suspended from the $CO_2$ chamber by means of polyester cords in the manner similar to that utilized in FIG. 3 where the isothermal heat shield is suspended from the nitrogen chamber. Otherwise the construction of FIG. 4 is similar to that previously described for FIG. 3.

The chamber 180 may be filled with a solid carbon dioxide approximately 195K°. At this pressure and temperature, and at approximately 1 atmosphere of pressure, solid carbon dioxide can undergo sublimation directly from a solid form to a gaseous form without passing through liquid state when heat is absorbed by it. Additional elements may be utilized in a dewar constructed in accordance with the present invention that may be filled with other liquid cryogenic materials, or with superinsulation or may contain isothermal shields or that may be evacuated in accordance with the teachings of the present invention. Each of the cryogen chambers contains a cryogen of a higher boiling, or a higher sublimation, and a higher latent heat of transformation temperature proceeding from the interior to the exterior of the dewar so that a change of state for each cryogen chamber occurs at a higher temperature than the next most inner chamber. Another alternate embodiment of the present invention may be achieved by substituting liquid neon for the liquid nitrogen in the chamber 31. In this embodiment the superinsulation 187 of FIG. 4 may be removed and a second heat shield, represented by dotted lines 35 may be suspended in the chamber 185, which is evacuated to a high vacuum by polyester cords. The shield 34 and the evacuated space 33 may be eliminated in this embodiment. The reason for using the heat shield 35 in this embodiment is the large difference in the latent heat of fusion of liquid neon versus that of solid $CO_2$.

In operation with a superconductor electric circuit, the circuit may be directly connected to the wall 36 of the helium chamber 30. Assuming that the space 33 between the helium chamber 30 and the isothermal shield 34 is at a high vacuum, a heat leak through this area can occur only through radiation or conduction, as for example, around a fill and exhaust tube or a support rod or cord. In an equilibrium state the heat generated will be balanced by the heat of vaporization of the liquid helium. Thus, for a helium chamber that holds approximately 1.6 liters of liquid helium, if the helium boils-off at a uniform rate over a period of six months, the net cooling power of the helium boil-off would be only approximately 0.26 milliwatts, in a representative embodiment.

One practical example of electronics circuitry that may be utilized with such a dewar is an 8 axis superconducting quantum interference device (SQUID) sensor. Each of these SQUID sensors consume about 10 microamps through a resistance of about 5 ohms. This gives a total heat production on the order of $4\times10^{-6}$ watts. The worse case heat generation from all of the sensors is 0.016 mW. For most applications the heat generated by the electronics, including superconducting electronics, will be negligible. Heat conduction around the liquid helium exhaust-fill tubes and the helium chamber support structure i largely balanced by the heat released by the helium boil-off if all of the members are properly heat sunk to the fill and exhaust tubes. Heat conduction may be minimized by choosing sinking materials with a low thermal conductivity and by maximizing their length.

In the dewar of the present invention heat radiation at approximately 300° K. will be intercepted by the superinsulation layers, the isothermal shield and the cryogenic liquids, which change states at successively higher temperatures as the dewar is transversed from the interior to the exterior. At each isothermal surface a heat balance is achieved where the incoming heat provided by radiation from the surrounding surfaces and the conduction from the surrounding surface down the exhaust-fill tubes and the support structures is balanced by the cooling effect that occurs due to the total specific heat, and the heat of vaporization of the helium vapor that reaches the isothermal surface. If an isothermal shield is used to enclose a cryogen chamber, cooling is also provided by the heat of vaporization of the cryogen in the chamber.

Several different techniques may be used to fill the $CO_2$ chamber of the embodiment of FIG. 4, which may be constructed of a glass epoxy, with solid C02 First the chamber can be cooled by conduction through fill and exhaust tubes for the $CO_2$ chamber of liquid nitrogen by prefilling them with liquid nitrogen and then liquid carbon dioxide may subsequently be transferred through these tubes. In a second method a solid $CO_2$/-freon slush can be transferred. As a third method the $CO_2$ chamber can be pressure regulated at about 90 p.s.i. during transfer of the liquid. Removing the pressure after the transfer will solidify and cool the $CO_2$ to a solid state.

Although an illustrative embodiment of a dewar has been described in which particular dimensions and configurations have been noted, these are not essential size or shape limitations since the dewar may be implemented with other configurations and dimensions within the scope of the present invention, which will be apparent to those skilled in the art.

We claim:

1. In a dewar for maintaining superconducting temperatures for an extended period of time comprising an outer case, comprising a plurality of cryogen containing chambers, the improved structure wherein the dewar is constructed so that each of said cryogen chambers completely surrounds the next innermost one of said cryogen chambers, and, except for the innermost one of said cryogen chambers, the cryogens contained in each of said chambers are maintained in states such that each cryogen has a progressively higher phase change temperature proceeding from the innermost one of said cryogen chambers to the outermost one of said cryogen chambers and isothermal suspension means for suspending all of said cryogen chambers within the dewar wherein the outermost one of said cryogen chambers is suspended in said dewar solely by isothermal suspension means comprising rods having a low thermal conductivity and all of said cryogen chambers, except said outermost cryogen chamber, are suspended in said dewar solely by isothermal suspension means comprising cords having a low thermal conductivity.

2. A dewar as claimed in claim 1 wherein said cords are interconnected in a staggered manner so that the origination and juncture points of said cords are such that the origination points of the cords at a first end of the dewar are located inwardly of the junction points of the cords at a second end of the dewar while the origination points of the cords at said second end of the dewar are located outwardly of the junction points at said first end of the dewar.

3. A dewar as claimed in claim 2 comprising at least one isothermal shield means, at least one evacuated space between two of said cryogen chambers and means for suspending said isothermal shield means in each of said evacuated spaces.

4. A dewar as claimed in claim 3 wherein each of said isothermal shields are suspended in evacuated spaces around cryogen chambers that contain a liquid cryogen.

5. A dewar as claimed in claim 4 wherein superinsulating material isolates the outermost cryogen chamber from the case of said dewar.

6. A dewar as claimed in claim 5 wherein a fill and exhaust means is provided which comprises a plurality of fill and exhaust tubes that are coupled to the liquid cryogen chambers of the dewar for exhausting and filling of each of the liquid cryogenic chambers with an appropriate liquid cryogen material.

7. A dewar as claimed in claim 6 wherein said fill and exhaust tubes are coiled and are heat sunk to various points in the interior of said dewar case, including points on said cords.

8. A dewar as claimed in claim 7 wherein said fill and exhaust means comprises pressure release means in fluid communication with said fill and exhaust tubes for relieving over pressure in said dewar.

9. A dewar as claimed in claim 8 wherein two liquid cryogen chambers are employed and the innermost chamber contains liquid helium, and the outermost chamber contains liquid nitrogen.

10. A dewar as claimed in claim 8 wherein three cryogen chambers are employed, the innermost chamber contains liquid helium, the outermost chamber contains solid carbon dioxide, and the intermediate chamber contains liquid nitrogen.

11. A dewar as claimed in claim 8 wherein three cryogen chambers are employed, the innermost chamber contains liquid helium, the outermost chamber contains solid carbon dioxide, and the intermediate chamber contains liquid neon.

12. A dewar as claimed in claim 1 wherein superinsulating material isolates the outermost cryogen chamber from the case of said dewar.

13. A dewar as claimed in claim 1 comprising at least one isothermal shield means, at least one evacuated space between two of said cryogen chambers and means for suspending said isothermal shield means in each of said evacuated spaces.

14. A dewar as claimed in claim 13 wherein each of said isothermal shields are suspended in evacuated spaces around cryogen chambers that contain a liquid cryogen.

15. A dewar as claimed in claim 1 wherein a fill and exhaust means is provided which comprises a plurality of fill and exhaust tubes that are coupled to the liquid cryogen chambers of the dewar for exhausting and filling of each of the liquid cryogenic chambers with an appropriate liquid cryogen material.

16. A dewar as claimed in claim 15 wherein said fill and exhaust tubes are coiled and are heat sunk to various points in the interior of said dewar case, including points on said cords.

17. A dewar as claimed in claim 16 wherein said fill and exhaust means comprises pressure release means in fluid communication with said fill and exhaust tubes for relieving over pressure in said dewar.

18. A dewar as claimed in claim 1 wherein two liquid cryogen chambers are employed and the innermost chamber contains liquid helium, and the outermost chamber contains liquid nitrogen.

19. A dewar as claimed in claim 1 wherein three cryogen chambers are employed, the innermost chamber contains liquid helium, the outermost chamber contains solid carbon dioxide, and the intermediate chamber contains liquid nitrogen.

20. A dewar as claimed in claim 1 wherein three cryogen chambers are employed, the innermost chamber contains liquid helium, the outermost chamber contains solid carbon dioxide, and the intermediate chamber contains liquid neon.

* * * * *